US005190848A

United States Patent [19]

Crawley

[11] Patent Number: 5,190,848

[45] Date of Patent: Mar. 2, 1993

[54] PHOTOGRAPHIC BETA-KETOAMIDE AND PHOTOGRAPHIC ELEMENTS CONTAINING THEM

[75] Inventor: Michael W. Crawley, Kingwood-Watford, Great Britain

[73] Assignee: Eastman Kodak Company, Rochester, N.Y.

[21] Appl. No.: 623,731

[22] PCT Filed: May 8, 1990

[86] PCT No.: PCT/GB90/00712

§ 371 Date: Dec. 10, 1990

§ 102(e) Date: Dec. 10, 1990

[87] PCT Pub. No.: WO90/13852

PCT Pub. Date: Nov. 15, 1990

[30] Foreign Application Priority Data

May 9, 1989 [GB] United Kingdom ..... 8910636

[51] Int. Cl.[5] ..... G03C 7/36

[52] U.S. Cl. ..... 430/389; 430/557

[58] Field of Search ..... 430/557, 389

[56] References Cited

U.S. PATENT DOCUMENTS

| | | | |
|---|---|---|---|
| 3,415,652 | 12/1968 | Porter | 430/557 |
| 3,542,840 | 11/1970 | Porter | 430/557 |
| 4,021,238 | 5/1977 | Hayashi et al. | 430/389 |
| 4,022,620 | 5/1977 | Okumura et al. | 430/389 |
| 4,066,457 | 1/1978 | Panosik et al. | 430/566 |
| 4,443,536 | 4/1984 | Lestina | 430/552 |
| 4,973,545 | 11/1990 | Moore | 430/557 |

FOREIGN PATENT DOCUMENTS

| | | | |
|---|---|---|---|
| 012660/74 | 3/1974 | Japan . | |
| 1231049 | 9/1989 | Japan | 430/557 |
| 1204495 | 6/1976 | United Kingdom . | |

OTHER PUBLICATIONS

Hackh's Chemical Dictionary, 4th Ed., pp. 134,647.

53038v, 74 Radiation Chemistry and Photochemistry, vol. 70, 1969.

8393d, Chem. Abstracts, vol. 74, 1971.

*Research Disclosure,* Item No. 308119, Dec. 1989.

*Research Disclosure,* Item No. 12255, Jun. 1974.

*Primary Examiner*—Lee C. Wright

*Attorney, Agent, or Firm*—Arthur E. Kluegel

[57] ABSTRACT

The invention provides a photographic coupler of the formula (I)

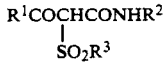

(I)

wherein $R^1$ and $R^2$ are substituted or unsubstituted aryl groups, and $R^3$ is a substituted or unsubstituted alkyl or aryl group. The couplers in accordance with the present invention provide image dyes of improved quality.

7 Claims, No Drawings

PHOTOGRAPHIC BETA-KETOAMIDE AND PHOTOGRAPHIC ELEMENTS CONTAINING THEM

The present invention relates to novel photographic yellow couplers particularly for color photography containing an aryl sulphonyl or alkyl sulphonyl group in the coupling position.

In Research Disclosure June 1974 pages 34 to 40 there are described some 54 compounds containing an active ketomethylene group of the formula $$(CH_3)_3CCOCHR''CONHR$$

wherein R and R'' are inter alia aryl or substituted aryl.

We have now found that compounds of this type are more effective if the coupling group is an alkyl or aryl sulphonyl group, and wherein the terminal butyl group is replaced by a substituted or unsubstituted aryl group.

According therefore to the present invention there is provided a photographic coupler of the general formula (I):

$$R^1COCH(SO_2R^3)CONHR^2 \quad (I)$$

wherein $R^1$ and $R^2$ are substituted or unsubstituted aryl groups and $R^3$ is a substituted or unsubstituted alkyl or aryl group.

In a preferred form of the invention $R^1$ is a substituted aryl group. Such a substituted aryl group is most preferably alkoxy substituted.

The group $R^3$ is preferably an alkyl substituted aryl group. The group $R^2$ is in a preferred form of the invention an aryl group substituted at the 2-position by a halogen group preferably a chlorine atom. In a most preferred form of the invention the group $R^2$ when substituted at the 2-position is also substituted at the 5-position.

The couplers of the invention may be included in a photosensitive photographic silver halide material, or in a multi colour photosensitive element comprising a support bearing a yellow dye image-forming unit comprised of at least one blue-sensitive silver halide emulsion layer having associated therewith at least one yellow dye-forming coupler, and at least one of the yellow dye-forming couplers is a coupler as just described.

The invention also comprehends a method of forming a photographic colour image which comprises developing an imagewise exposed silver halide emulsion layer with a primary aromatic amino color developing agent in the presence of a color coupler in accordance with the foregoing formula (I).

The dye-forming couplers of this invention can be used in the ways and for the purposes that dye-forming couplers have been previously used in the photographic art. They may be dissolved in processing solutions (unballasted) or incorporated into photographic materials (normally ballasted).

Typically, the couplers are incorporated in silver halide emulsions and the emulsions coated on a support to form a photographic element. Alternatively, the couplers can be incorporated in photographic elements adjacent the silver halide emulsion where, during development, the coupler will be in reactive association with development products such as oxidized color developing agent. Thus, as used herein, the term "associated therewith" signifies that the coupler is in the silver halide emulsion layer or in an adjacent location where, during processing, it will come into reactive association with silver halide development products.

The photographic elements can be single color elements or multicolor elements. In a multicolor element, the yellow dye-forming couplers of this invention would usually be associated with a blue-sensitive emulsion, although they could be associated with an emulsion sensitized to a different region of the spectrum, or with a panchromatically sensitized, orthochromatically sensitized or unsensitized emulsion. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element would comprise a support bearing a yellow dye image-forming unit comprised of at least one blue-sensitive silver halide emulsion layer having associated therewith at least one yellow dye-forming coupler, at least one of the yellow dye-forming couplers being a coupler of this invention, and magenta and cyan dye image-forming units comprising at least one green- or red-sensitive silver halide emulsion layer having associated therewith at least one magenta or cyan dye-forming coupler respectively. The element can contain additional layers, such as filter layers.

In the following discussion of suitable materials for use in the emulsions and elements of this invention, reference will be made to Research Disclosure, December 1989, Item 308119 published by Industrial Opportunities Ltd., The Old Harbourmaster's, 8 North Street, Emsworth, Hants P010 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers of this invention, the elements of the invention can include additional couplers as described in Research Disclosure Section VII, paragraphs D, E, F and G and the publications cited therein. The couplers of this invention and any additional couplers can be incorporated in the elements and emulsions as described in Research Disclosures of Section VII, paragraph C and the publications cited therein.

The photographic elements of this invention or individual layers thereof, can contain brighteners (see Research Disclosure Section V), antifoggants and stabilizers (see Research Disclosure Section VI), antistain agents and image dye stabilizer (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-N,N-diethylaniline hydrochloride, 4-amino-3-methyl-N-ethyl-N-β-(methanesulfonamido)ethylaniline sulphate hydrate, 4-amino-3-methyl-N-ethyl-N-β-hydroxyethylaniline sulphate, 4-amino-3-β-(methanesulfonamido)ethyl-N,N-diethylaniline hydrochloride and 4-amino-N-ethyl-N-(2-methoxyethyl)-m-toluidine di-p-toluene sulfonate.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively a direct positive emulsion can be employed to obtain a positive image.

Development is followed by the conventional steps of bleaching, fixing or bleach-fixing, to remove silver and silver halide, washing and drying.

Specific couplers (A to D) according to the present invention are listed in Table I below by way of Example; coupler (E) is a comparison coupler.

TABLE I (A)

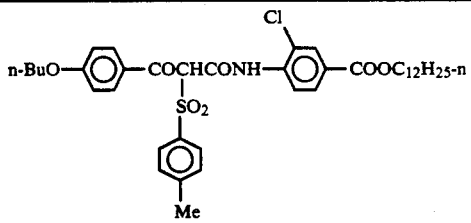

(B)

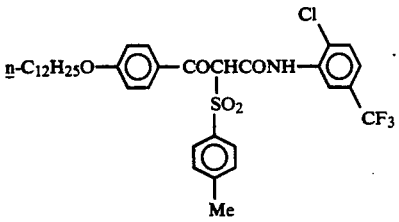

(C)

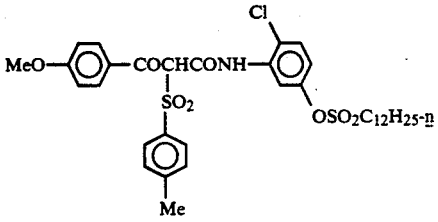

TABLE I-continued (D)

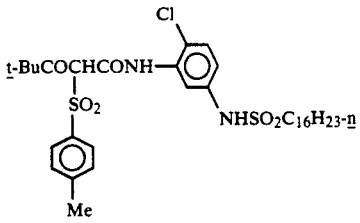

(E)

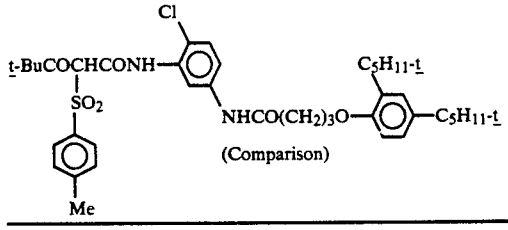

(Comparison)

The examples (A–D) of the couplers of the invention were prepared by the following method, exemplified by the preparation of coupler (C):

Preparation of Coupler (C).

N-(2-Chloro-5-dodecylsulphonyloxyphenyl)-2-(4-methylphenylsulphonyl)-3-oxo-3-(4-methoxyphenyl)-propionamide.

N-(2-Chloro-5-dodecylsulphonyloxyphenyl)-2-chloro-3-oxo-3-(4-methoxyphenyl)propionamide (5.86 g) was dissolved in dimethylformamide (25 ml) and sodium 4-methylphenylsulphinate (2.7 g) added. The mixture was stirred for 30 minutes at room temperature, poured into water (300 ml) and the gum extracted into ethyl acetate, washed with water and dried. Removal of the solvent and crystallisation of the residue from ethanol gave white platelets of coupler (C), 5.8 g, 82%.

TABLE 2

Elemental Analysis and Yields of Couplers

| Coupler No. | | % C | % H | % Cl | % N | % S | % Yield |
|---|---|---|---|---|---|---|---|
| (of the invention) | Reqs: | 65.8 | 7.1 | 5.0 | 2.0 | 4.5 | 79 |
| | Fd: | 65.8 | 7.1 | 5.0 | 2.0 | 4.4 | |
| (B) | Reqs: | 61.8 | 6.1 | 5.2 | 2.1 | 4.7 | 80 |
| | Fd: | 61.8 | 6.1 | 5.0 | 2.0 | 4.8 | |
| (C) | Reqs: | 69.5 | 6.3 | 5.0 | 2.0 | 9.1 | 82 |
| | Fd: | 69.5 | 6.3 | 4.8 | 2.0 | 8.8 | |
| (D) | Not Isolated in a Pure State | | | | | | |
| (E) | Reqs: | 66.3 | 7.3 | 4.8 | 3.9 | 4.4 | 41 |
| | Fd: | 66.1 | 7.3 | 4.9 | 3.9 | 4.6 | |

WORKING EXAMPLES OF THE INVENTION

Coating Formulation

Coupler of the invention was dissolved in di-n-butylphthalate (1:0.5) with the aid of cyclohexanone (1.5) as auxiliary solvent and dispersed in gelatin to give a dispersion containing coupler (9%/wt) and gel (6%/wt). The dispersion was washed at 4° C. for 6 hours and coated with a blue sensitised silver halide emulsion in the following single layer photographic format:

| | |
|---|---|
| Supercoat | gel 1.50 g/m2 |
| Sensitised Layer | |

-continued

| | |
|---|---|
| Supercoat | gel 1.50 g/m2 |
| | gel 2.42 g/m2<br>coupler 1.93 mmole/m2<br>silver halide emulsion 0.81 g/m2<br>bis(vinylsulphonyl)methane 0.06 g/m2 |
| Acetate Support | |

Couplers (B) and (C) and comparison coupler (E) were similarly coated on an equimolar basis.

Sensitometric Testing

The coatings were slit into 35 mm strips and exposed through a 0–4.0 neutral density step wedge (0.2 ND step units) and Daylight V, Wratten 35 and 38A and 0.3ND filters. The strips were then processed through a deep-tank sink line at 37.8° C. using the standard Kodacolor C-41 development process:

| | |
|---|---|
| Developer | 2.5 mins |
| Bleach | 4 mins |
| Wash | 2 mins |
| Fix | 4 mins |
| Wash | 2 mins |

Dye densities were measured using a Macbeth TD504/Hewlett Packard 85 automatic transmission densitometer and the maximum density (Dmax), minimum density (Dmin), contrast ($\nu$) and photographic speed (S) obtained. The hues ($\lambda$max) and half band width (HBW) of the generated dyes are also recorded below. These are shown in Table 3.

TABLE 3

| Coupler | Dmin | Dmax | ($\nu$) | S | $\lambda$max/nm | HBW/nm |
|---|---|---|---|---|---|---|
| (A) | 0.13 | 0.56 | 0.27 | 288 | 449 | 82.5 |

TABLE 3-continued

| Coupler | Dmin | Dmax | ($\nu$) | S | $\lambda$max/nm | HBW/nm |
|---|---|---|---|---|---|---|
| (B) | 0.13 | 0.81 | 0.42 | 282 | 452.5 | 81 |
| (C) | 0.17 | 0.71 | 0.34 | 266 | 452 | 81.5 |
| E | Dye density too low to measure sensitomertry and dye hue. | | | | | |

I claim:

1. A multicolor photographic element comprising a support bearing a yellow dye image-forming unit comprised of at least one blue-sensitive silver halide emulsion layer having associated therewith at least one yellow dye-forming coupler of the general formula (I):

$$R^1COCH(SO_2R^3)CONHR^2 \quad (I)$$

wherein $R^1$ and $R^2$ are substituted or unsubstituted aryl groups, and $R^3$ is a substituted or unsubstituted alkyl or aryl group.

2. An element according to claim 1 wherein $R^1$ is a substituted aryl group.

3. An element according to claim 2 wherein $R^1$ is an alkoxy substituted aryl group.

4. An element according to claim 1 wherein $R^3$ is an alkyl substituted aryl group.

5. An element according to claim 1 wherein $R^2$ is an aryl group substituted at the 2-position by a halogen group.

6. An element according to claim 5 wherein $R^2$ is additionally substituted at the 5-position.

7. A method of forming a photographic color image which comprises developing an imagewise exposed silver halide emulsion layer with a primary aromatic amino color developing agent in the presence of a photographic element according to any of claims 1, and 2–6.

* * * * *